United States Patent [19]

Joseph

[11] Patent Number: 4,620,723

[45] **Date of Patent: * Nov. 4, 1986**

[54] SKI POLE

[75] Inventor: Claude Joseph, Sallanches, France

[73] Assignee: Kerma, Sallanches, France

[ * ] Notice: The portion of the term of this patent subsequent to Apr. 2, 2002 has been disclaimed.

[21] Appl. No.: 704,704

[22] Filed: Feb. 25, 1985

Related U.S. Application Data

[63] Continuation-in-part of Ser. No. 445,977, Dec. 1, 1982, Pat. No. 4,508,364.

[30] Foreign Application Priority Data

Dec. 3, 1981 [FR] France ..... 81 22967

[51] Int. Cl.[4] ..... A63C 11/22

[52] U.S. Cl. ..... 280/821; D8/DIG. 6

[58] Field of Search ..... 280/821, 822, 819; 272/70; 16/110 R; D8/DIG. 6; 135/65, 71, 72, 76, 84

[56] References Cited

U.S. PATENT DOCUMENTS

| | | | |
|---|---|---|---|
| 1,600,046 | 9/1926 | Goldwin | 135/76 |
| 4,196,742 | 4/1980 | Owen, Jr. | 280/822 X |
| 4,248,256 | 2/1981 | Thomas | 135/71 X |
| 4,288,101 | 9/1981 | Aho | 280/821 |
| 4,391,456 | 7/1983 | Moor | 280/821 |
| 4,508,364 | 4/1985 | Joseph | 280/821 |

FOREIGN PATENT DOCUMENTS

| | | | |
|---|---|---|---|
| 865945 | 2/1953 | Fed. Rep. of Germany | 135/65 |
| 2842931 | 4/1980 | Fed. Rep. of Germany | 280/821 |

*Primary Examiner*—John J. Love
*Assistant Examiner*—Michael Mar
*Attorney, Agent, or Firm*—Karl F. Ross; Herbert Dubno

[57] ABSTRACT

The handle of a ski pole has its grip axis offset from the axis of the shaft of the pole and set at least rearwardly thereof to allow the point of the pole to engage the snow substantially more forwardly than an ordinary pole and thus with a more acute angle. The inclination of the grip axis can be adjusted.

4 Claims, 10 Drawing Figures

SKI POLE

CROSS-REFERENCE TO RELATED APPLICATION

The present application is a continuation-in-part of my copending application Ser. No. 445,977, filed Dec. 1, 1982, now U.S. Pat. No. 4,508,364 issued Apr. 2, 1985.

FIELD OF THE INVENTION

My present invention relates to a ski pole and, more particularly, to a ski pole whose handle axis is offset from the axis of the shaft of the pole.

BACKGROUND OF THE INVENTION

Ski poles are commonly used by a skier in Alpine skiing, in downhill, slalom, competition and cross-country activity and in cross-country skiing for pleasure, competition, long-distance skiing and the like. The ski poles provide balance, facilitate turning and are used to propel the skier and even to assist in braking the movement of the skier.

Generally the skier holds one pole in each hand and each pole can comprise a shaft or shank which can be composed of a metal, of synthetic resin tube, and which is provided with a grip at its upper end and a point at its lower end.

The grip may be formed as a sleeve around the shaft and thus has its axis coincident with that of the shaft. A flexible loop or strap can be affixed to the head of the grip to be fitted over the wrist of the skier and thereby prevent loss of the poles.

The points, which are adapted to bite into snow or ice generally project somewhat beyond the disk or ring at the lower end of the pole serving to prevent excess penetration of the pole into the snow and to enable the pole to gain a more effective purchase on the snow.

The grip can be molded from a synthetic resin material and thus is an extension of the shaft or surrounds the latter.

As skiing techniques have evolved and reached high levels, both for competition skiing and even sophisticated pleasure skiing, it has become increasingly important to enable the skier to plant his poles well forwardly of his feet for many skiing maneuvers.

Thus, while earlier skiing techniques required the poles to remain more or less upright when the points were planted ahead of the skier, i.e. at arms length even with the skier in a crouching position, more modern techniques require the poles to be inclined forwardly and downwardly i.e. to form an acute angle with the slope or ski surface so that the points of the poles are planted a considerable distance ahead of the hands of the skier, and of course, as the skier crouches forwardly, substantially more forwardly of the feet.

OBJECTS OF THE INVENTION

It is the principal object of the invention to provide a skiing pole which facilitates the higher level skiing techniques described above by allowing the points of the poles to be planted well forwardly of the feet of the skier.

Another object of this invention is to provide an improved ski pole structure which will allow the points of the pole to engage the snow substantially forwardly of the skier without undue strain upon him or her.

It is also an object of this invention to provide an improved ski pole of greater versatility and adaptability than earlier ski poles.

SUMMARY OF THE INVENTION

These objects and others which will become apparent hereinafter are attained, in accordance with the present invention, in a ski pole having a shaft (which may be provided with the usual point and ring or disk) and a grip at the upper end of the shaft positioned so that the axis of this grip is offset and spaced from the axis of the shaft. More specifically, this grip is not coaxial with the shaft but is offset from the central axis thereof and is rearwardly of the shaft and, if desired, also laterally offset from the shaft.

The rearward orientation can be best noted by recognizing that the grip has a front and back because of its shape, the shaft being located forwardly of the front of the grip and, if desired, laterally thereof.

According to a feature of the invention, the grip is connected to the shaft by appropriate brackets, links or coupling members and these coupling members may be oriented or structured to provide a fixed orientation of the grip relative to the shaft or an adjustable orientation.

Furthermore, the axis of the grip may be parallel to the axis of the shaft or oblique thereto and the grip may be located at the same height as the upper end of the shaft or thereabove, i.e. the shaft may terminate below the grip.

When adjustment means is provided, it has been found to be advantageous to provide adjustment of the spacing of the grip from the upper end of the shaft, angular adjustability of the grip or the axis of the shaft and angular adjustability as well about a further axis perpendicular to the last mentioned adjustment axis as well as the axis of the grip.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
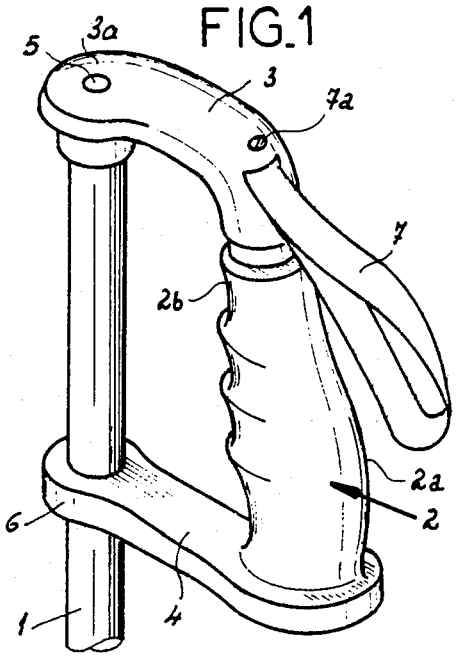
FIG. 1 is a rear side perspective view of one embodiment of a grip according to the invention affixed to the upper end of the shaft and a ski pole.
Figure 2:
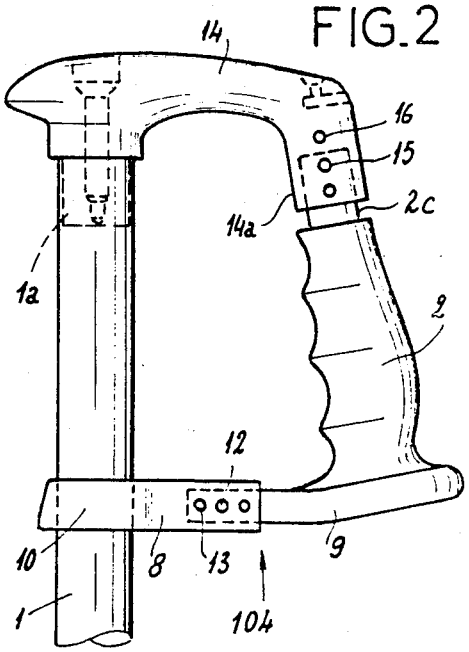
FIG. 2 is a side elevational view of a similar grip but representing a second embodiment of the invention wherein the grip is adjustable at least limitedly on the shaft.
Figure 3:
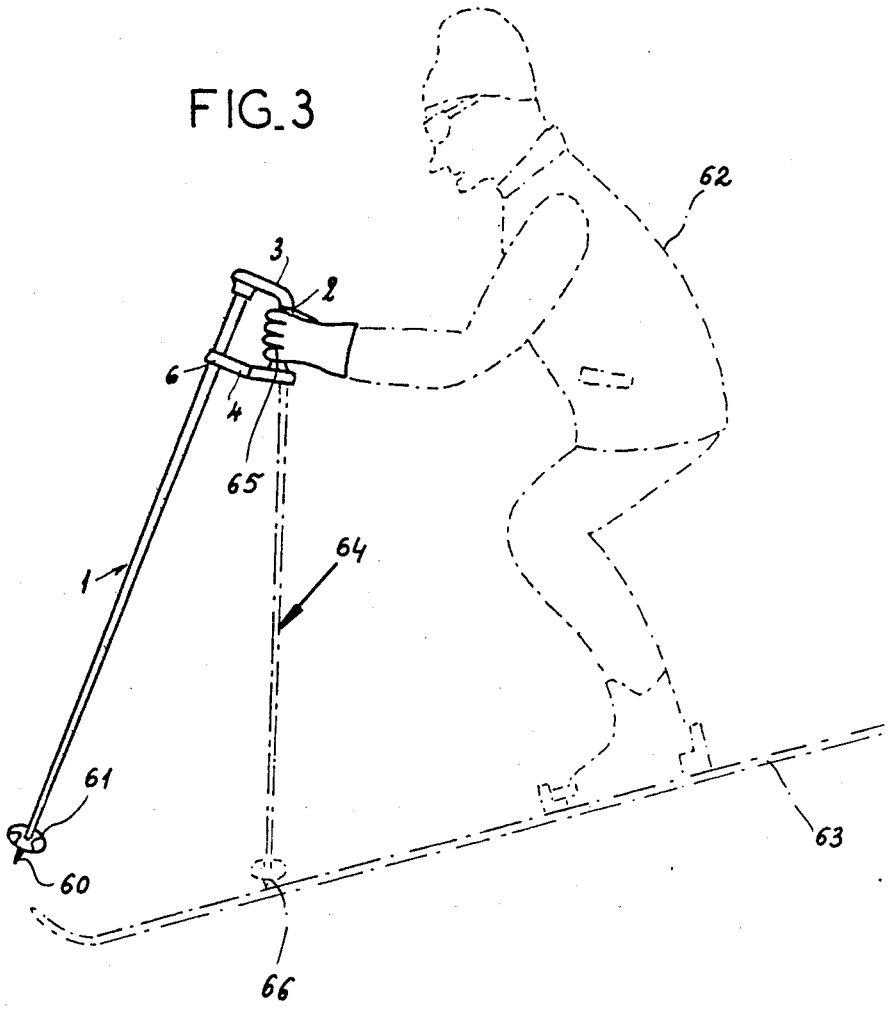
FIG. 3 is a diagrammatic side elevational view showing the difference in results obtained with a ski pole according to the invention in downhill skiing by comparison with a conventional pole.

In FIGS. 1–3 I have shown D-type grips for a ski pole whose shaft is represented at 1 and which is provided at its lower end with a point 60 projecting below a flexibly mounted ring or disk 61. When the skier 62 on the skis 63 (FIG. 3) grips a conventional ski pole 64, in a normal posture of the hand 65, the point 66 of this pole is planted almost directly below the hand and is practically perpendicular to the snow surface. If the skier wishes to plant the points further forwardly of his hands, he is compelled to contort his hands, strain his wrists and otherwise engage in maneuvers which are neither confortable nor advisable.

With a grip according to the invention, however, as can be seen in solid lines in FIG. 3, with the hands in the normal orientation, the point 60 of the pole can be planted well forwardly of the position taken by the ordinary poles.

In the discussion of FIGS. 1, 2 and 4–8, therefore, it will be understood that similar functions apply and that the shaft 1 of each of the poles shown therein ar provided with the point 60 and ring 61 common to such skipoles and previously described.

The D-grips each include a handle 2 which can be molded from synthetic-resin material and this can have an appropriate orientation, the back 2*a* being smooth but rounded to fit the contour of the palm while the front 2*b* is indented to form recesses for the fingers.

In all of the embodiments, the axis of the handle 2 is offset from the axis of the shaft 1 and, in the embodiments described, can be inclined upwardly to intersect the axis of the shaft at a location well above the pole. In the embodiments of FIGS. 1–3, moreover, the two axes are coplanar.

The handle 2 (FIG. 1) is affixed by two substantially parallel arms 3 and 4 which, however, of different lengths, the upper arm 3 being shorter than the lower arm 4.

The upper arm 3 terminates in a head 3*a* which forms a cap receiving the upper end of the tubular shaft 1 and is provided with a centered orifice into which a screw can be threaded to anchor the handle to the shaft. This screw can be threaded into a plug fitted in the tubular shaft and represented in broken lines at 1*a* in FIG. 2.

The lower arm is formed with an eye 6 force fitted over the shaft tube 1 and thus engaging the latter without play. The grip is also advantageously provided with a strap loop 7 held in place by a screw 7*a* to prevent loss of the pole as previously described.

The greater length of the lower arm 4 and the shorter length of the upper arm 3 impart an oblique orientation to the handle as shown in FIGS. 1 and 3, this oblique orientation being such that the axis of the handle is inclined upwardly toward the axis of the shaft. Of course, if a different gripping of the pole is desired for a particular skiing technique, the axis of the grip can be inclined downwardly toward the axis of the shaft.

In the embodiment shown in FIG. 2, the angle of the axis of the grip can be adjusted. In this embodiment, the lower arm 104 comprises an eye 10 whose stem 8 telescopingly receives the stem 9 at the bottom of the handle 2 and the depth of insertion of the stem 9 into the sleeve portion formed by the stem 8 can be adjusted by inserting a pin 12 into one of a number of holes 13 of the sleeve which can be aligned with a hole of the stem 9.

Consequently, by the telescoping connection of the pin locking arrangement, the effective length of the member 104 can be adjusted to increase or reduce the angle of inclination of the axis of the handle 2 relative to the axis of the shaft 1.

A tongue 2*c* of the handle 2 can pivot within a sleeve 14*a* of the upper arm 14 to permit such adjustment of the angle of the axis of handle 2. The pivoting action may be effected about a pin 15 which can be inserted into a selected number of holes 16 in the sleeve 14*a* which can be aligned with a hole of the tongue 2*c* to permit vertical adjustment of the position of the handle for comfort of the user.

Of course, during the molding of the handle 2 integrally with the stem 8 or after molding with heat and/or pressure, one can also adjust the angle without necessarily utilizing a variation in length of the lower arm.

In general, this angle should be the angle which provides the desired acute angle between the shaft and the snow surface (FIG. 3) in a comfortable position of the hands.

In addition, it is possible to adjust the angular orientation of the handle by the use of a screw which is adapted to deform the latter about its stem 8 either clockwise or counterclockwise from the orientation shown in FIG. 2.

Figure 4:
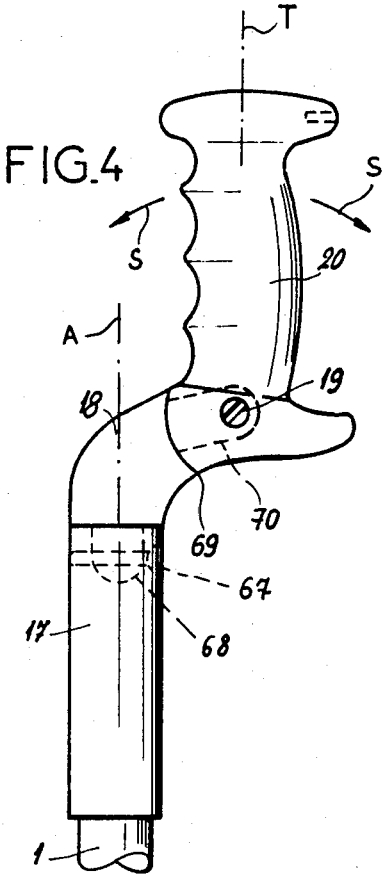
FIG. 4 is a side elevational view of another ski pole showing how the grip may be tilted about an axis perpendicular to the grip axis and generally horizontal when the pole is held in a vertical position.
Figure 5:
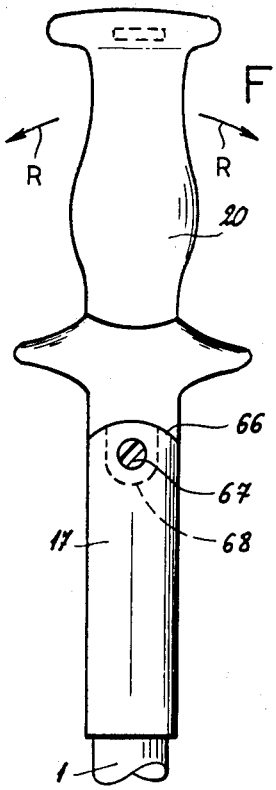
FIG. 5 is a rear view of this pole showing the means for allowing the grip to be tilted about another horizontal axis so that the grip can be adjusted in two orthogonal directions.

FIGS. 4 and 5 show an I-type grip according to the invention. In this embodiment, the shaft or tube 1 of the ski pole is encased at its upper end in a sleeve 17 which is formed with a head 18 constituting an elbow. A joint 66 between the elbow and the sleeve 17 is arcuate and centered on a pivot axis along which a screw 67 extends. The screw 67 can be tightened to lock a lug 68 from the elbow against movement. The grip can thereby be swung in the clockwise or counterclockwise direction (FIG. 5) as represented by the arrows R about the pivot axis defined by the screw 67.

Rearwardly of the elbow, the molded handle 20 is provided with a joint 69 between the elbow 18 and the handle and is likewise formed as an arcuate or hinged point with a pivot axis along the screw 19 which can lock the handle 20 to the lug 70 of the elbow 18. This permits pivotal movement about the axis of screw 19 as represented by arrows S in FIG. 4. The adjustability permits the axis T of the handle to be swung obliquely to the axis A of the shaft.

Figure 6:
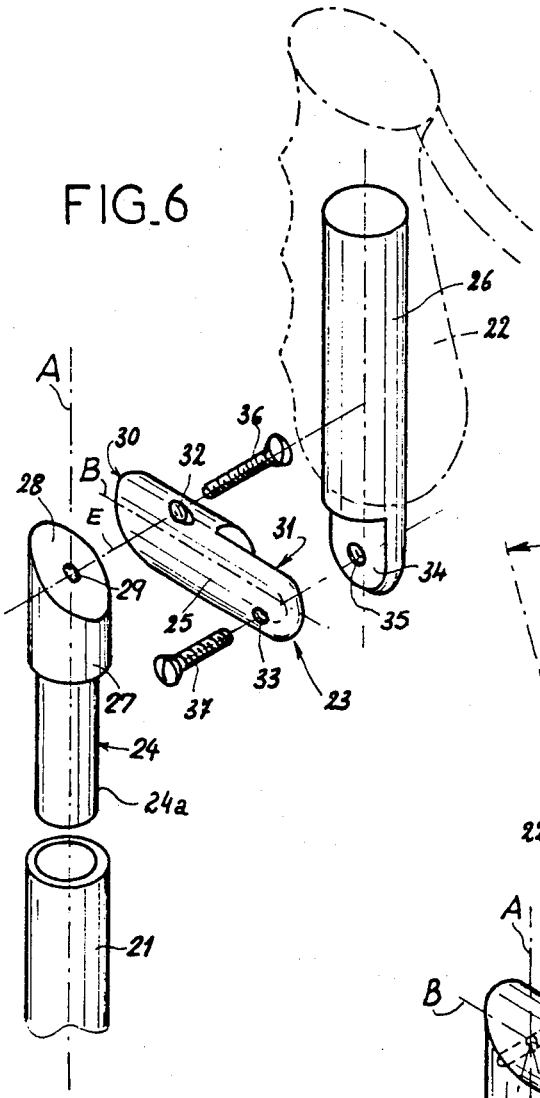
FIG. 6 is a diagrammatic exploded view illustrating another grip according to the invention.
Figure 7:
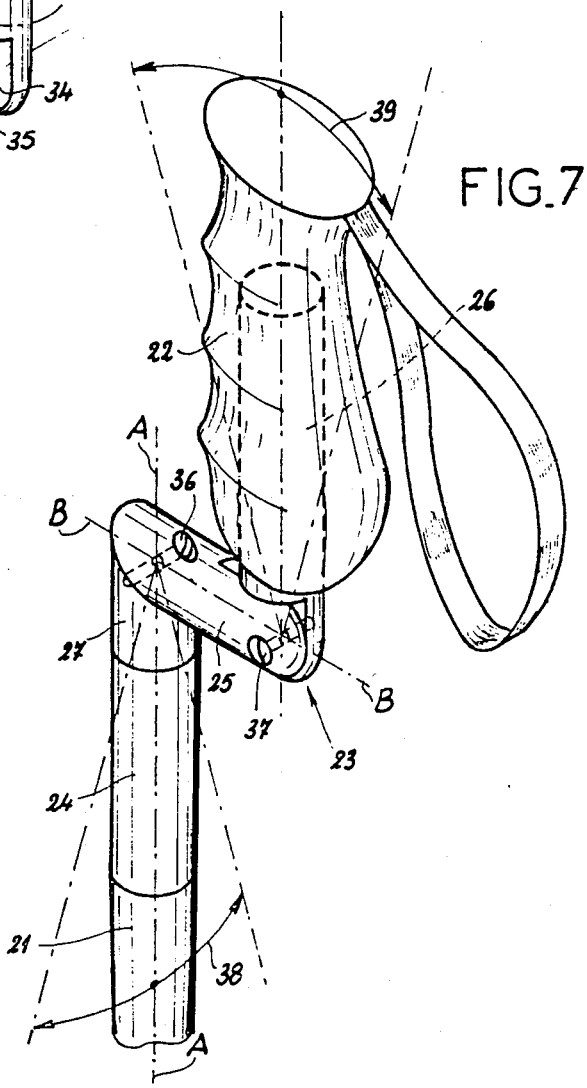
FIG. 7 is a perspective view of the assembled grip of FIG. 6.

In yet another embodiment of the invention shown in FIGS. 6 and 7, similar adjustability is afforded by the way in which the handle is connected to the tubular shaft 21 of the ski pole.

The handle 22 has been shown in dot-dash lines in FIG. 6 and can be mounted on the core 26 by any conventional means. It is shown in place in solid lines in FIG. 7 and has an I-configuration generally similar to the handle of FIGS. 4 and 5.

The shaft 21 and the handle 22 are connected by a mechanism represented generally at 23 composed of three main elements 24, 25 and 26.

The lower element 24 is formed with a cylindrical tenon 24*a* adapted to be force fitted or otherwise anchored in the tube 21 forming the shaft. The lower element terminates in a head 27 whose end face 28 is oblique to the longitudinal axis A of the pole. A threaded bore 29, directed along the axis E inclined to the axis A is also provided in this head.

The intermediate element 25 is a cylindrical bar with the same diameter as the head 27 and with an oblique face 30 adapted to rest against the oblique face 28 and form a right angle joint with the latter. The axis of element 25 has been represented at B and thus is perpendicular to the axis A.

A bore 32 is formed in member 25 and a screw 36 can be threaded into the bore 29 after passing through the bore 32 to lock members 24 and 25 together.

The two members can be angularly adjusted through an angle 38, for example, by loosening and retaining of the screw 36.

The other end of member 25 is formed with a lug 31 adapted to lie flat against a lug 34 of member 26. The lug 34 is provided with a threaded hole 35 which can be engaged by a screw 37 inserted through a bore 33 of lug 31. By loosening the screw 37, the angular orientation of the handle can be adjusted through the angle 39 (FIG. 7) whereupon the screw can be retightened.

The screws 36 and 37 thus allow adjustment of the group relative to the shaft of the ski pole in the manner described.

Figure 8:
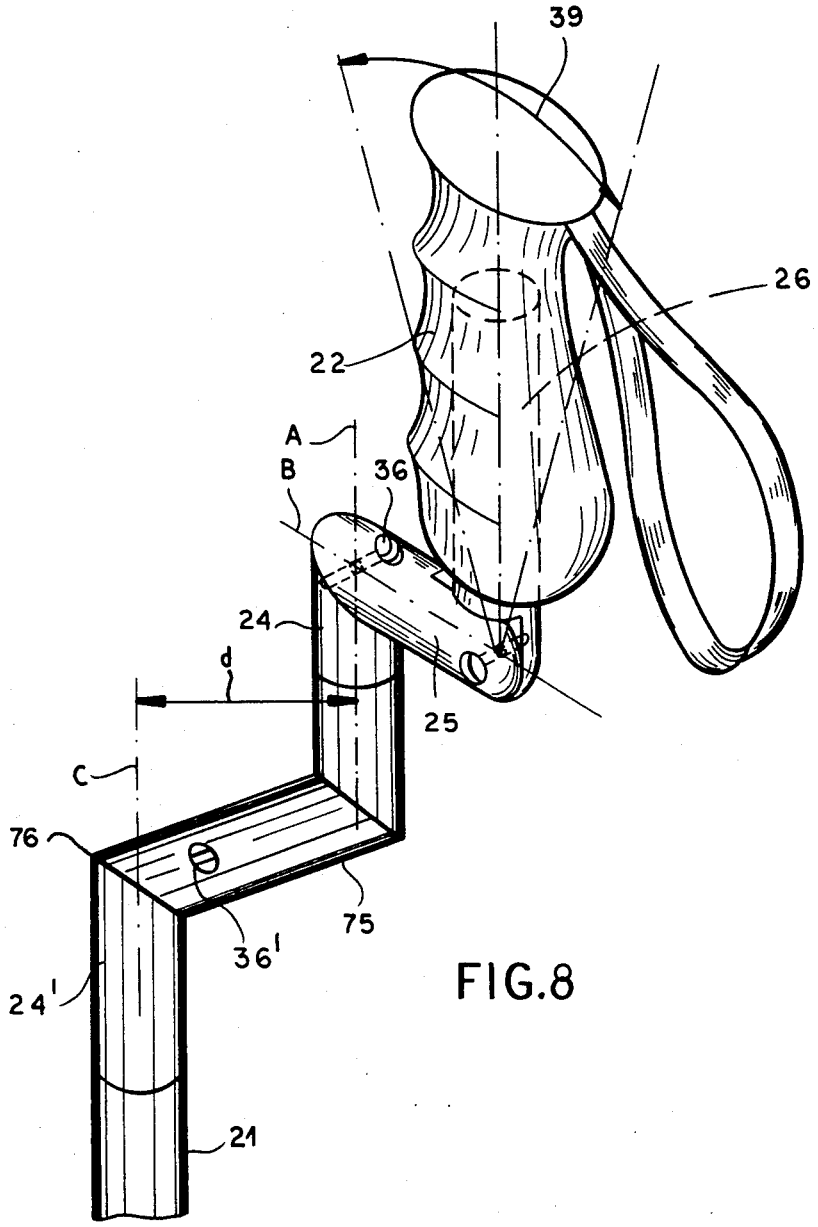
FIG. 8 illustrates an embodiment of the invention where the grip lies both rearwardly and laterally of the shaft of the pole.

The embodiment of FIG. 8 differs from that of FIGS. 6 and 7 only in that the member 24 is connected to the pole 21 through an additional pair of elbows formed by, for example, a further member 24' in all respects similar to member 24, and a right angled member 75 which can be friction fitted to member 24 and connected to member 24' with a screw 36' analogous to the screw 36. This allows a full lateral offset of the handle with respect to the shaft and an additional degree of adjustability about the joint 76.

Figure 9:
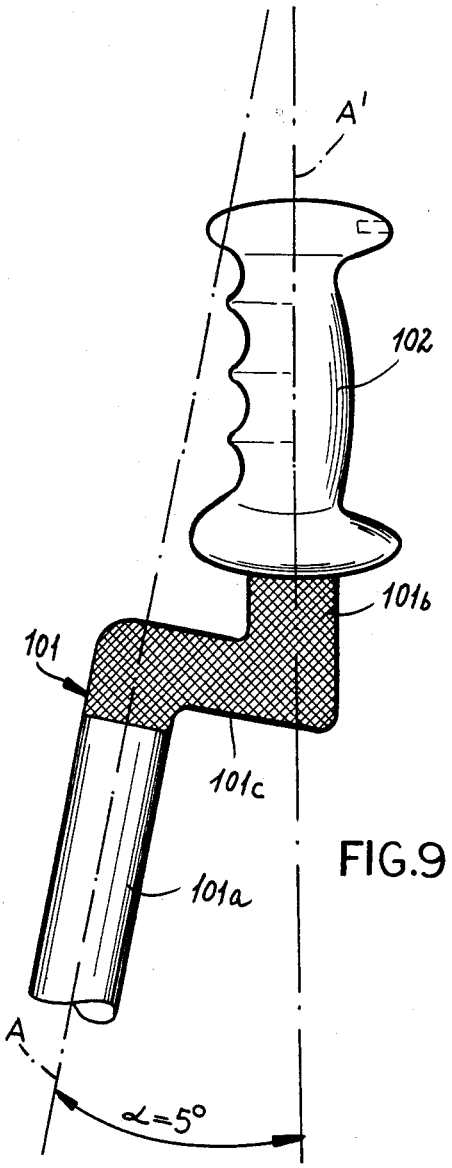
FIG. 9 is a side elevational view of the upper end of a ski pole according to another embodiment of the invention.
Figure 10:
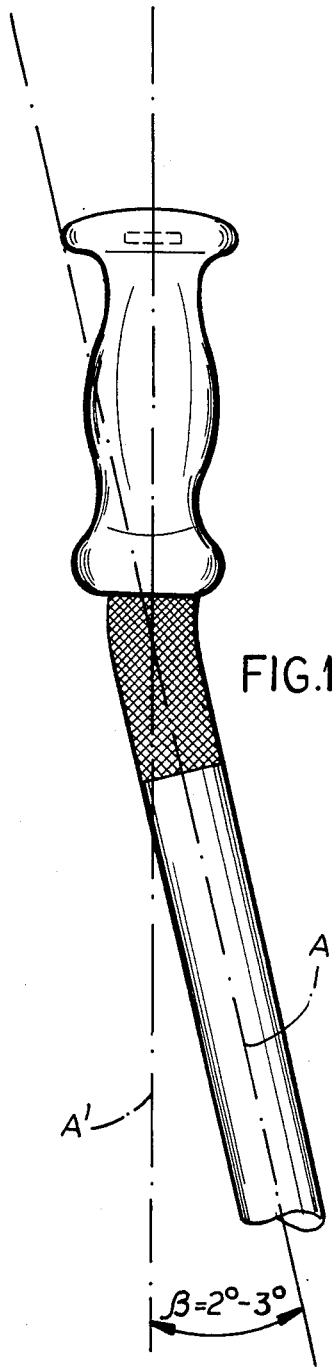
FIG. 10 is a front elevational view of FIG. 9.

FIGS. 9 and 10 show another embodiment of a ski pole in which the pole shaft 101 is formed with a straight shank 101*a* extending from the lower end to the upper end thereof along an axis A, the upper end being formed with rearwardly directed offset arm 10*lc* and a further shaft portion or upright or zipper arm 101*b* centered on the vertical axis A' and having a contoured grip 102 mounted thereon, the axis A of the shank 101*a* being forwardly inclined to the axis A' of the grip 102 and forms an angle $\alpha=5°$ therewith, as shown particularly in FIG. 9. As can be seen in FIG. 10, the axis A of shank 101*a* is also inclined laterally to the axis A' of grip 102 to form an angle $\beta=2°-3°$ therewith, whereby the shank and point of the ski pole is directed diagonally away from the skier to enable the pole to gain a more effective purchase on the snow while at the same time clearing the skis.

I claim:

1. A ski pole comprising a grip, a pole shaft, and an arm assembly mounting said grip on said pole shaft, said pole shaft having:

a straight shank, a lower end aligned with said shank, and an upper end remote from said lower end, said arm assembly having:

a rearwardly directed arm portion on said upper end of said shank and coplanar therewith, and an upper arm portion on said rearwardly directed arm portion remote from said upper end and centered on an upright axis when said grip is in a vertical position and grasped by a skier's hand, said upper arm portion being coplanar with said rearwardly directed arm portion, a plane of said shank and said rearwardly directed arm portion intersecting a plane of said upper arm portion and said rearwardly directed arm portion and forming therebetween an acute angle, said upper arm portion and said shank forming between them another acute angle, and said grip being mounted on said upper arm portion oriented such that, when said grip is in said vertical position, said shank, extends downwardly and forwardly of said grip at an inclination to the vertical.

2. The ski pole defined in claim 1 wherein said shank extends forwardly at a fixed angle to said grip and laterally at a fixed angle to said grip.

3. The ski pole defined in claim 2 wherein said shank extends forwardly at an angle of 5° to said grip and laterally at an angle of 2° to 3° to said grip.

4. The ski pole defined in claim 1 wherein said shank forms respective forward and lateral angles to said grip.

* * * * *